United States Patent [19]

Flanagan

[11] 4,065,409

[45] Dec. 27, 1977

[54] HARD SURFACE DETERGENT COMPOSITION

[75] Inventor: John J. Flanagan, Chicago, Ill.

[73] Assignee: Corporate Brands, Inc., Chicago, Ill.

[21] Appl. No.: 601,054

[22] Filed: Aug. 1, 1975

[51] Int. Cl.[2] ..... C11D 1/62; C11D 1/75; C11D 1/835; C11D 3/075

[52] U.S. Cl. ..... 252/528; 252/89 R; 252/173; 252/321; 252/358; 252/547; 252/DIG. 1; 252/DIG. 8; 252/DIG. 14

[58] Field of Search ..... 252/89, 106, 528, 547, 252/173, 321, 358, DIG. 1, DIG. 2, DIG. 14

[56] References Cited

U.S. PATENT DOCUMENTS

| | | | |
|---|---|---|---|
| 3,296,145 | 1/1967 | Findlan | 252/106 |
| 3,351,557 | 11/1967 | Almstead | 252/106 |
| 3,360,470 | 12/1967 | Wixon | 252/99 |
| 3,470,102 | 9/1969 | Heinz | 252/547 |
| 3,537,993 | 11/1970 | Coward | 252/8.75 |
| 3,812,046 | 5/1974 | Lancz | 252/106 |
| 3,843,563 | 10/1974 | Davies | 252/547 |

*Primary Examiner*—Dennis L. Albrecht
*Attorney, Agent, or Firm*—Kegan, Kegan & Berkman

[57] ABSTRACT

An improved detergent mixture for cleaning hard surfaces comprising a mixture of a non-ionic detergent, a tertiary amine oxide, and a quaternary dimethyl ammonium halide. The mixture having a particular combination of ingredient concentrations described exhibits improved detergency compared with compositions containing only one or two of these ingredients at equivalent concentrations.

6 Claims, No Drawings

HARD SURFACE DETERGENT COMPOSITION

This invention relates to detergent compositions and more particularly to an improved detergent composition for cleaning hard surfaces comprising a mixture of a nonionic detergent, a tertiary amine oxide, and a quaternary ammonium halide, the combination of these ingredients exhibiting improved detergent properties compared to compositions containing any one or two of said ingredients at equivalent concentrations.

Hard surface detergents, with which this invention is concerned, are intended for cleaning surfaces such as those of painted wood, plaster or wall board, tile, glass, metal, linoleum and the like, which tend to accumulate a soil containing both solid as well as oil substances. To be suitable for such use, a hard surface detergent should have high solvent power for both solid and oily soils, and great miscibility with water, in order to permit dilution over a wide range of concentrations as well as to facilitate rinsing of the surface after the cleaning operation is completed. In addition to its solvent power and miscibility with water, an ideal hard surface detergent composition should be biodegradable, non-toxic and non-irritating to the skin, and it should give off no obnoxious or irritating fumes.

In accordance with the invention, an improved hard surface detergent composition having the above-described properties comprises an aqueous solution of a non-ionic detergent characterized by having a polyoxyethylene chain in its molecule, a tertiary amine oxide, a quaternary ammonium halide, a builder for the non-ionic detergent and a defoaming agent, all as more fully hereinafter described. Although each of the non-ionic detergent, the tertiary amine oxide, and the quaternary ammonium halide used in the invention is known to have detergent or surface-active properties, the invention is based on the unexpected discovery that when used in combination, these ingredients provide a detergent effect which is much greater than that achieved by the use of any one or two of those materials at equivalent concentrations. Although the reason for the result is unknown, it appears that the ingredients have a potentiating or synergistic effect when all three are combined in a hard surface detergent composition in accordance with the invention.

The non-ionic detergent used in the invention belongs to a class of compounds formed by condensation of an alkyl phenol, an alkyl amine, or an aliphatic alcohol with sufficient ethylene oxide to produce a compound having a polyoxyethylene chain within the molecule, i.e., a chain composed of recurring ($—O—CH_2—CH_2—$) groups. Many compounds of this type are known and used for their detergent, surface active, wetting and emulsifying properties. The detergents of this type which can be used in the invention are those produced by the condensation of about 5–30, and preferably about 8–16, moles of ethylene oxide with 1 mole of (1) an alkyl phenol having about 0–15, and preferably 7–10, carbon atoms in the akyl group; (2) an alkyl amine having about 10–20, and preferably 12–16, carbon atoms in the alkyl group; and (3) an aliphatic alcohol having about 10–20, and preferably 12–16, carbon atoms in its molecule. The number of moles of ethylene oxide which are condensed with 1 mole of parent compound (i.e., the alkyl phenol, the alkyl amine, or the aliphatic alcohol) depends on the molecular weight of the hydrophobic portion of the condensation product. The nonionic detergent used in the invention should have sufficient ethylene oxide units to insure solubility thereof in the detergent composition or in any dilution thereof which may be used in practice. In general, the nonionic detergents suitable for use in the invention can be formed by condensing the reactants in the proportions given above.

The alkyl phenols which can be condensed with ethylene oxide to give a nonionic detergent useful in the invention are those in which the alkyl group contains about 0–15, and preferably about 7–10, carbon atoms in a straight or branched chain, which can be saturated or unsaturated. Particularly preferred nonionic detergents of this type comprise the condensation products of 1 mole of octyl phenol condensed with about 10 moles of ethylene oxide. Examples of other suitable alkyl phenol-ethylene oxide condensation products are those in which the hydrophobic portion of the product is derived from phenol, methyl phenol (cresol), ethyl phenol, hexylphenol, decylphenol, dodecylphenol, and the like.

The other nonionic detergents which can be used in the invention are those wherein an alkyl amine or aliphatic alcohol, in which the alkyl group in each case has about 10–20, and preferably about 12–16, carbon atoms in a straight or branched chain which can be saturated or unsaturated, is condensed with about 5–30, and preferably about 8–16, moles of ethylene oxide. Examples of such compounds are the condensation products of ethylene oxide with decylamine, dodecylamine, tridecylamine, hexadecylamine, octadecylamine, and the like; and with decyl alcohol, dodecyl alcohol, tridecyl alcohol, hexadecyl alcohol, octadecyl alcohol and the like.

The second ingredient in the synergistic combination of surface active agents used in the invention is a tertiary amine oxide, specifically an alkyl di(lower alkyl) amine oxide in which the alkyl group has about 10–20, and preferably 12–16, carbon atoms, and can be straight or branched chain, saturated or unsaturated. Examples of suitable tertiary amine oxides useful in the invention include lauryl dimethyl amine oxide, myristyl dimethyl amine oxide, and those in which the alkyl group is a mixture of different chain lengths, such as lauryl/myristyl dimethyl amine oxide, dimethyl cocamine oxide, dimethyl (hydrogenated tallow) amine oxide, and myristyl/palmityl dimethyl amine oxide.

The third ingredient in the synergistic combination of surface active agents used in the invention, is a quaternary ammonium halide surfactant having the formula $$\left[\begin{array}{c} R_1 \\ R_2—N—R_4 \\ R_1 \end{array}\right]^+ X^-$$

where $R_1$ and $R_2$ are lower (i.e., $C_1$–$C_7$) alkyl, and preferably methyl groups; $R_3$ is an alkyl or phenyl-substituted alkyl group having about 1–18, and preferably about 8–12 carbon atoms; $R_4$ is an alkyl or phenyl-substituted alkyl group having about 10–20, and preferably 12–18, carbon atoms; and X is a halogen, preferably chlorine. Examples of suitable quaternary ammonium halide surfactants include dioctyl dimethyl ammonium chloride, octyl decyl dimethyl ammonium chloride, didecyl dimethyl ammonium chloride, ($C_{12}$–$C_{18}$) n-alkyl dimethyl benzyl ammonium chloride, ($C_{12}$–$C_{14}$) n-alkyl dimethyl ethylbenzyl ammonium chloride, and dimethyl (difatty) ammonium chloride.

Also incorporated in the detergent composition of the invention are conventional builders commonly known and used in conjunction with synthetic detergents, which function to improve the detergent properties of the composition. The builders are typically alkaline salts such as the alkali metal carbonates, phosphates, and silicates. In addition to improving the detersive properties of the composition, such builders control and maintain the pH of the bath, modify the adsorption of the detergent on the substrate and/or the soil and act as suspending or peptizing agents. Examples of suitable builders for use in the invention include sodium tripolyphosphate, tetra sodium pyrophosphate, trisodium phosphate, sodium carbonate, sodium orthosilicate, sodium metasilicate and the corresponding potassium salts.

The three main ingredients used in the detergent composition of the invention, being surface active agents, have a tendency to generate copious quantities of foam during the use of the detergent composition. The presence of foam is not necesssary for the detergent effect produced and in many applications, such as the mechanical or handmopping of a floor, foam is undesirable. Accordingly, the composition of the invention comprises a small quantity of an anti-foam agent in an amount sufficient to prevent foaming. Typically, small concentrations, on the order of 0.001–0.01% by weight of an anti-foam agent can be used. The anti-foam agent can be any conventional type, including those based on silicones (e.g., methyl polysiloxanes) or other water-insoluble oils of low volatility and strong spreading power. Other anti-foam agents which can be used include glyceride oils, fatty acids, and higher alcohols and glycols.

The invention is illustrated by the following examples.

EXAMPLE I

A preferred detergent concentrate in accordance with the invention has the following composition:

| Ingredient | Percent by Weight |
|---|---|
| Nonionic detergent (condensation product of 1 mole of octyl phenol with 9–13 moles of ethylene oxide) | 1.70 |
| Tertiary amine oxide (lauryl dimethyl amine oxide) | 0.28 |
| Quaternary ammonium surfactant (didecyl dimethyl ammonium chloride) | 0.38 |
| Builders | |
| sodium metasilicate | 2.56 |
| sodium carbonate | 1.70 |
| tetrasodium pyrophosphate | 1.28 |
| Water | 92.10 |
| | 100.00 |

The composition is homogeneous, highly stable against phase separation in storage, and can be readily diluted with up to 100 parts of water, or more, to give detergent solutions useful for a wide variety of hard surface cleaning applications.

EXAMPLE II

The composition of Example I was diluted with water in the ratio of about 20 parts of water to 1 part of detergent concentrate. About 4 ounces of the diluted solution was placed into a beaker and about 2cc. each of a vegetable oil and a used automobile crank case oil were added. On stirring by hand, the vegetable and mineral oils were emulsified within about 30 seconds forming a stable homogeneous emulsion with the detergent solution.

For comparison, the above test was repeated using a detergent solution prepared from a commercially available hard surface detergent in which the detergent is primarily butyl cellosolve. When diluted to give a detergent solution containing an equal concentration of active ingredients, the commercial solution was unable to emulsify the added vegetable and mineral oils.

EXAMPLE III

In this example, there was employed a test procedure recommended by the Chemical Specialties Manufacturers Association (Tentative Method, revised 3/15/74, "Evaluating the Relative Efficiency of Aqueous Cleaners on Painted Surfaces"). In the test, glass panels coated with a standard white paint are marked by means of standard test pencils and crayons which are applied under controlled increasing pressure to the painted surface to form a series of lines. The detergent to be tested is evaluated for its ability to remove or reduce the intensity of the lines on the glass panels using a Gardner Straightline Washability Apparatus. The effectiveness of a test detergent solution is evaluated against the performance of a standard solution having the following composition:

| | |
|---|---|
| Sodium carbonate | 0.5% by weight |
| Sodium tripolyphosphate | 0.2% |
| Butyl cellosolve | 5.0% |
| Nonionic detergent (condensation product of 1 mole of octylphenyl with about 10 moles of ethylene oxide) | 0.5% |
| Water | 93.8% |
| | 100.0% |

The detergent concentrate of Example I, diluted to a water content of 93.8% to match the standard solution, was evaluated against the standard. For use, each concentrate was diluted with water in the ratio of 20 parts water per part of concentrate. The results showed that the solution of the invention was more effective in removing or lightening the applied markings. The concentrate of Example 1 achieved a rating of 7 (total removal) for the crayon markings, and a rating of 6 (faint trace of soil remaining) for the pencil markings. By contrast, the standard solution had a rating of 2 (slight decrease in soil) for the crayon markings and a rating of 4 (50% of soil remaining) for the pencil markings.

The foregoing detailed description has been given for clearness of understanding only, and no unnecessary limitations should be understood therefrom, as modifications will be obvious to those skilled in the art.

What is claimed is:

1. A detergent concentrate composition comprising:

A. about 1.5–2.0% by weight of a non-ionic detergent which is a condensation product of about 8–16 moles of ethylene oxide with one mole of a compound selected from the group consisting of 1. an alkyl phenol having about 7–10 carbon atoms in the alkyl group;
2. an alkyl amine having about 12–16 carbon atoms in the alkyl group; and
3. an aliphatic alcohol having about 12–16 carbon atoms;

B. about 0.25–0.30% by weight of an alkyl dimethyl amine oxide in which the alkyl group has about 12–16 carbon atoms;

C. about 0.30–0.40% by weight of a quaternary ammonium halide having the formula $$\left[\begin{array}{c} R_2 \\ R_1-N-R_4 \\ R_3 \end{array}\right]^+ X^-$$

where $R_1$ and $R_2$ are methyl; $R_3$ is methyl or a phenyl-substituted alkyl group having about 8–12 carbon atoms; and $R_4$ is an alkyl group having about 12–18 carbon atoms;

D. about 5–5.8% by weight of an alkaline inorganic builder selected from the group consisting of the alkali metal carbonates, phosphates, and borates; and E. a defoaming agent in an amount effective to control foaming of the composition in use; and F. the remainder water.

2. A composition in accordance with claim 1 in which said non-ionic detergent is the condensation product of one mole of octyl phenol with about 9–13 moles of ethylene oxide.

3. A composition in accordance with claim 1 in which said non-ionic detergent is the condensation product of one mole of an aliphatic alcohol having about 12–15 carbon atoms with about 9 moles of ethylene oxide.

4. A composition in accordance with claim 1 in which said builder is selected from the group consisting of tetrasodium pyrophosphate, sodium metasilicate, sodium carbonate, and mixtures thereof.

5. A liquid hard-surface detergent composition comprising an aqueous solution containing about 1 part by weight of the composition of claim 1 diluted with about 0.1 to 100 parts by weight of water.

6. The detergent concentrate composition of claim 1, wherein said composition comprises about 0.001 – 0.01% by weight of a defoaming agent.

* * * * *